US011414878B2

(12) United States Patent
Xie et al.

(10) Patent No.: US 11,414,878 B2
(45) Date of Patent: Aug. 16, 2022

(54) UNLOCKING STRUCTURE OF WORKBENCH LADDER

(71) Applicant: SUZHOU PICA ALUMINUM INDUSTRY LTD., Jiangsu (CN)

(72) Inventors: Xiaoyan Xie, Suzhou (CN); Longyuan Lu, Suzhou (CN)

(73) Assignee: SUZHOU PICA ALUMINUM INDUSTRY LTD, Suzhou (CN)

( * ) Notice: Subject to any disclaimer, the term of this patent is extended or adjusted under 35 U.S.C. 154(b) by 188 days.

(21) Appl. No.: 16/636,512

(22) PCT Filed: Aug. 31, 2017

(86) PCT No.: PCT/CN2017/100074
§ 371 (c)(1),
(2) Date: Feb. 4, 2020

(87) PCT Pub. No.: WO2019/024163
PCT Pub. Date: Feb. 7, 2019

(65) Prior Publication Data

US 2020/0256070 A1 Aug. 13, 2020

(30) Foreign Application Priority Data

Aug. 4, 2017 (CN) ..... 201720972662.4

(51) Int. Cl.
*E04G 1/30* (2006.01)
*E04G 1/34* (2006.01)
(Continued)

(52) U.S. Cl.
CPC ..... *E04G 1/30* (2013.01); *E04G 1/34* (2013.01); *E04G 7/34* (2013.01); *E06C 1/393* (2013.01); *B25H 5/00* (2013.01); *E04G 2001/305* (2013.01)

(58) Field of Classification Search
CPC .. E04G 1/30; E04G 1/34; E04G 1/393; E04G 2001/305; E04G 7/34; E06C 1/393; B25H 5/00
See application file for complete search history.

(56) References Cited

U.S. PATENT DOCUMENTS 1,639,009 A * 8/1927 Singley ..... A47B 91/00 403/95
3,554,318 A * 1/1971 Knight ..... E06C 1/39 182/24
(Continued)

FOREIGN PATENT DOCUMENTS

CN 2248482 Y 3/1997
CN 2908669 Y 6/2007
(Continued)

OTHER PUBLICATIONS

May 4, 2018 Search Report issued in International Patent Application No. PCT/CN2017/100074.

*Primary Examiner* — Colleen M Chavchavadze
*Assistant Examiner* — Shiref M Mekhaeil
(74) *Attorney, Agent, or Firm* — Oliff PLC

(57) ABSTRACT

An unlocking structure of workbench ladder includes a platform and two ladders hinged to the two ends of the platform; wherein, the ladder includes an unlocking structure relative to the hinged joint of the platform, and the unlocking structure includes an operating button, rotating lock tongue and a first elastic element; the rotating lock tongue is arranged in the column and the upper end is a locking hook which is locked and located in the locking plate at the bottom of the platform; the first elastic element acts between the rotating lock tongue and the column driving and positioning the locking hook toward the locking plate to lock the ladder and the platform; the operating button acts on the rotating lock tongue to overcome the first
(Continued)

elastic element and drive the locking hook to move in a direction opposite to the locking plate, unlocking the ladder and the platform.

8 Claims, 11 Drawing Sheets

(51) Int. Cl.

| | |
|---|---|
| ***E04G 7/34*** | (2006.01) |
| ***E06C 1/393*** | (2006.01) |
| *B25H 5/00* | (2006.01) |

(56) References Cited

U.S. PATENT DOCUMENTS

| | | | | |
|---|---|---|---|---|
| 4,967,877 | A * | 11/1990 | Wallman | B25H 1/06 182/155 |
| 5,332,062 | A * | 7/1994 | Revere | E04G 1/34 182/118 |
| 5,358,069 | A * | 10/1994 | Krause | E04G 1/154 182/118 |
| 5,542,639 | A * | 8/1996 | Wixey | B23D 47/025 108/117 |
| 7,690,316 | B2 * | 4/2010 | Yoo | E04G 1/34 108/115 |
| 8,113,316 | B2 * | 2/2012 | Sward | G01N 33/497 182/222 |
| 9,422,768 | B2 * | 8/2016 | Yoo | E06C 1/393 |
| 9,512,627 | B2 * | 12/2016 | Taron | B25H 1/06 |
| 9,752,334 | B2 * | 9/2017 | Foley | B25H 1/04 |
| 10,012,000 | B2 * | 7/2018 | Yoo | E04G 1/22 |
| 10,030,447 | B2 * | 7/2018 | Pyros | E04G 1/18 |
| 10,035,255 | B2 * | 7/2018 | Cindric | E06C 7/16 |
| 10,161,184 | B2 * | 12/2018 | Lampe | E04G 5/10 |
| 10,738,487 | B2 * | 8/2020 | Woodward | E04G 1/32 |
| D895,844 | S * | 9/2020 | Woodward | D25/66 |
| D895,845 | S * | 9/2020 | Woodward | D25/66 |
| 10,801,219 | B2 * | 10/2020 | Parker | E04G 1/154 |
| 10,815,680 | B2 * | 10/2020 | Woodward | E04G 1/30 |
| 10,858,848 | B2 * | 12/2020 | Woodward | E04G 1/30 |
| 2004/0238278 | A1 * | 12/2004 | Gibson | E06C 1/393 182/129 |
| 2004/0238280 | A1 * | 12/2004 | Gibson | E04G 1/34 182/153 |
| 2006/0169539 | A1 * | 8/2006 | Grebinoski | E04G 1/30 182/223 |
| 2009/0133959 | A1 * | 5/2009 | Eriksson | E04G 1/34 182/118 |
| 2010/0071996 | A1 * | 3/2010 | Huang | E06C 1/39 182/118 |
| 2011/0056764 | A1 * | 3/2011 | Cross | E06C 1/32 182/27 |
| 2014/0190769 | A1 * | 7/2014 | Parker | E06C 1/387 182/159 |
| 2017/0275897 | A1 * | 9/2017 | Weadward | E04G 1/30 |
| 2018/0171648 | A1 * | 6/2018 | Woodward | E04G 1/32 |
| 2019/0226217 | A1 * | 7/2019 | Foley | E04G 1/34 |
| 2019/0387887 | A1 * | 12/2019 | Yan | E04G 7/34 |

FOREIGN PATENT DOCUMENTS

| | | | |
|---|---|---|---|
| CN | 103990971 | A | 8/2014 |
| CN | 107553457 | A | 1/2018 |
| CN | 207245136 | U | 4/2018 |
| JP | 2002-201794 | A | 7/2002 |

* cited by examiner

UNLOCKING STRUCTURE OF WORKBENCH LADDER

TECHNICAL FIELD

The utility model relates to a folding workbench for work at high place, particularly to an unlocking structure of workbench ladder.

BACKGROUND OF INVENTION

The workbench, also known as the working platform, is a common tool for work at high place. It is mainly used to provide a working platform above the ground for users to stand to facilitate operations such as car washing. The workbench can be used not only indoors, but also outdoors and it can be used for car washing, decoration, maintenance, picking and storage.

As shown in FIGS. 1 and 2, the existing workbench usually comprises two ladders 1 and a platform 2 and the upper ends of the two ladders 1 are respectively hinged below the front and rear ends of the platform 2 and the platform 2 serves as a working surface for the user to stand on; several rungs 3 are provided at the bottom of the platform 2 in parallel intervals along its length direction to strengthen the structural strength of the platform 2, and the quantity of rungs 3 is directly proportional to the length of the platform 2 with three and four as common quantity; the platform 2 is sealed by the end cover structure 4 at both ends at the length direction.

An unlocking structure 5 is provided at the hinged joint of the two ladders 1 and the platform 2 of the existing workbench and the unlocking structure 5 is used to lock the open and folded state of the two ladders 1 of workbench or the unlocking structure 5 is used to unlock the two ladders 1 to so that they can rotate below the ends of the platform 2. The problem with this prior art is: Since the existing unlocking structure 5 is arranged at the side of the platform 2 in the width direction, on the one hand, the operation is not convenient when the user unlocks the platform and on the other hand, as the unlocking structure 5 can often be touched inadvertently during the transportation and use of the workbench, it can directly cause the damage of the unlocking structure 5, resulting in the unlocking failure of the workbench.

Therefore, it's a subject for the utility model to solve the deficiencies of the above-mentioned prior art.

DISCLOSURE OF THE INVENTION

The purpose of the utility model is to provide an unlocking structure of workbench ladder.

In order to achieve the above purpose, the utility model applies the technical solution: An unlocking structure of workbench ladder, and the workbench comprises two ladders and a platform, and the upper ends of the two ladders are respectively hinged to the front and rear ends of the platform in the length direction; several rungs are provided at the bottom of the platform in parallel intervals along its length direction; the ladders comprise two columns and steps connected between the two columns; wherein:

An unlocking structure is arranged on each of the ladder respectively corresponding to its hinged joint with the platform. In the open state of the ladder, the unlocking structure is arranged along the length direction of the platform;

The unlocking structure comprises an operating button, a rotating lock tongue and a first elastic element;

the rotating lock tongue is vertically arranged along the height direction of the ladder and is rotatably arranged in the column, and the rotation axis of the rotating lock tongue is arranged along the width direction of the platform; the upper end of the rotating lock tongue is a locking hook, and the locking hook extends out of the top surface of the column and is locked and positioned on a locking plate at the bottom of the platform; The first elastic element acts between the rotating lock tongue and the column for driving the locking hook to move toward the locking plate, so that the locking hook is locked and positioned on the locking plate to achieve the locking of the ladder and the platform;

The operating button is protruded on the outer side of the column along the length direction of the platform, and acts on the rotating lock tongue to overcome the force of the first elastic element and drive the locking hook to move in a direction opposite to the locking plate, thereby unlocking the lock which locks the locking plate with the locking hook and achieving the unlocking of the ladder and the platform.

The above described technical solution is explained as follows:

1. In above described technical solution, the operating button is a press button and a first driving pin is positioned in the rotating lock tongue and the first driving pin is disposed parallel to the rotation axis of the rotating lock tongue; a locating slot or a locating hole is disposed on the press button in relative to the first driving pin, and the locating slot or the locating hole is sleeved on the first driving pin to become the point of force application of the press button to the rotating lock tongue; In the open state of the ladder, the press button applies a pressing force to the rotating lock tongue in the forward and backward direction perpendicular to the length direction of the column to force the rotation of the rotating lock tongue.

2. In above described technical solution, the press button is provided with a locating slot in relative to the first driving pin and the locating slot has a length, which constitutes a stroke of point of force application by the press button to the rotating lock tongue; and it also consists of a second elastic element and the second elastic element acts between the press button and the rotating lock tongue.

The second elastic element is a spring, and the design of the second elastic element with the locating slot could extend the pressing stroke of the press button and improve the user's feel.

3. In above described technical solution, the operating button is a push button, and the rotating lock tongue is provided with a bevel along the length direction of the column and a second driving pin is positioned in the push button in relative to the bevel and the second driving pin is disposed parallel to the rotation axis of the rotating lock tongue and it abuts the bevel to become a point of force application of the push button to the rotating lock tongue; In the open state of the ladder, the push button applies a pushing force to the bevel of the rotating lock tongue in the upward and downward direction parallel to the length direction of the column to force the rotation of the rotating lock tongue.

4. In above described technical solution, the first elastic element is a spring, and may also be a tension spring or a torsion spring.

5. In above described technical solution, the locking hook is provided with a slope along the length direction of the rotating lock tongue and the slope works with the locking plate. When the ladder is opened from the folding state, the slope gradually abuts the locking plate and when the ladder is fully opened, the locking hook is locked to the locking plate. It could achieve the automatic locking of the locking hook and the locking plate when the ladder is opened and achieve the automatic locking in the open state of the workbench through the design of the slope. It solves the problem that user of the prior art may forget to operate the unlocking mechanism for locking due to negligence, resulting in personal injury.

The working principle and advantages of the utility model are as follows: An unlocking structure of workbench ladder of the utility model comprises a platform and two ladders hinged to the two ends of the platform; wherein, the ladder is provided with an unlocking structure in relative to the hinged joint of the platform, and the unlocking structure comprises an operating button, rotating lock tongue and a first elastic element; the rotating lock tongue is rotatably arranged in the column and the upper end is a locking hook, and the locking hook is locked and located in the locking plate at the bottom of the platform; the first elastic element acts between the rotating lock tongue and the column to drive the locking hook to be positioned toward the locking plate to achieve the locking of the ladder and the platform; the operating button acts on the rotating lock tongue to overcome the first elastic element and drive the locking hook to move in a direction opposite to the locking plate, achieving the unlocking of the ladder and the platform.

Compared with the prior art, the utility model has the smart structure design and has practical and progressive feature such as convenient unlocking operation.

Figure 1:
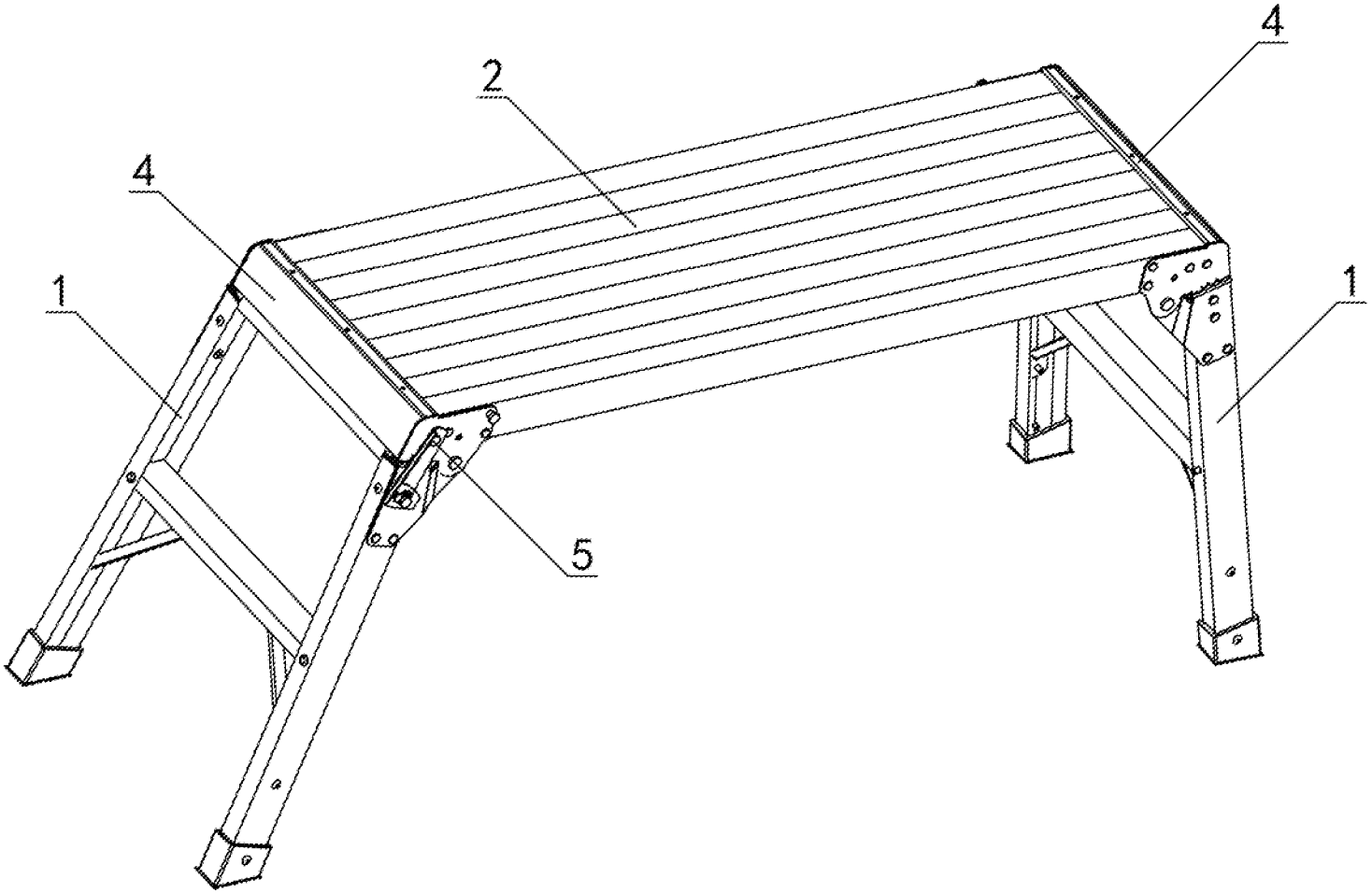
FIG. 1 Prior Art
FIG. 1 is a schematic view 1 of the existing workbench (three-dimensional)
Figure 2:
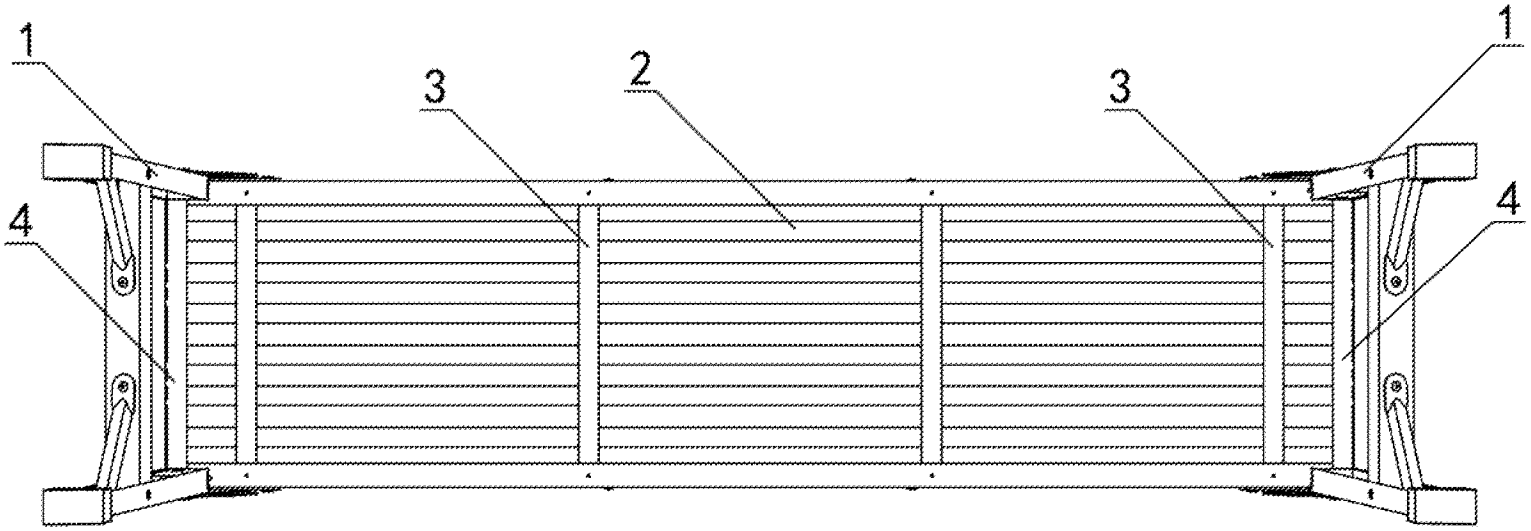
FIG. 2 Prior Art
FIG. 2 is a schematic view 2 of the existing workbench (bottom)
Figure 3:
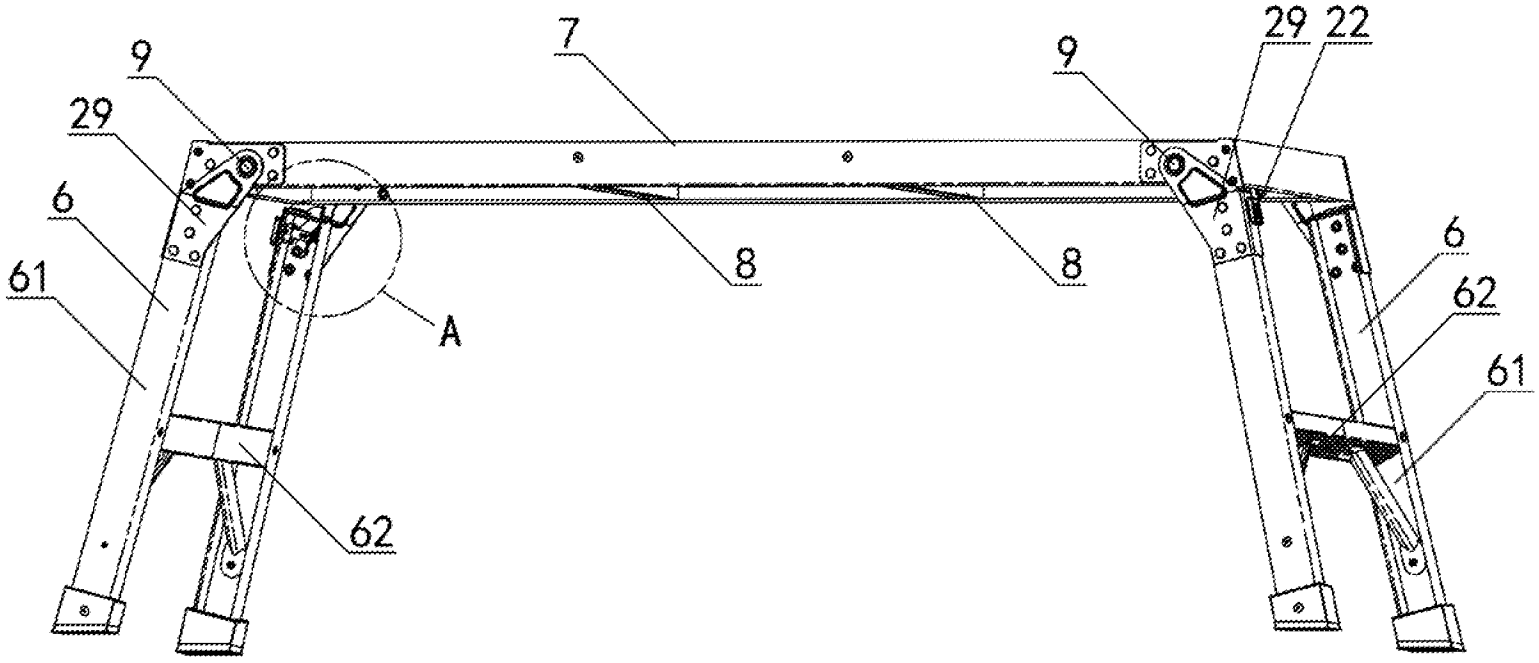
FIG. 3 is a schematic view 1 of the workbench of embodiment of this utility model (press button type)
Figure 4:
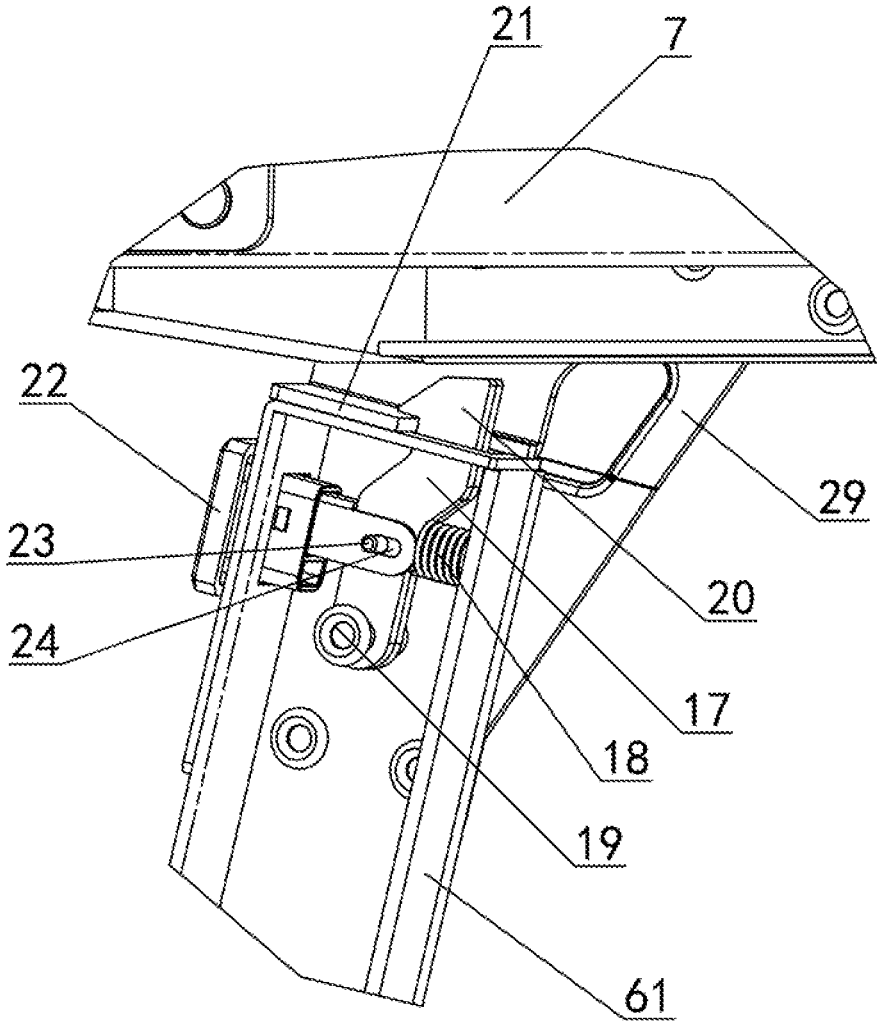
FIG. 4 is a local enlarged view of position A in FIG. 3.
Figure 5:
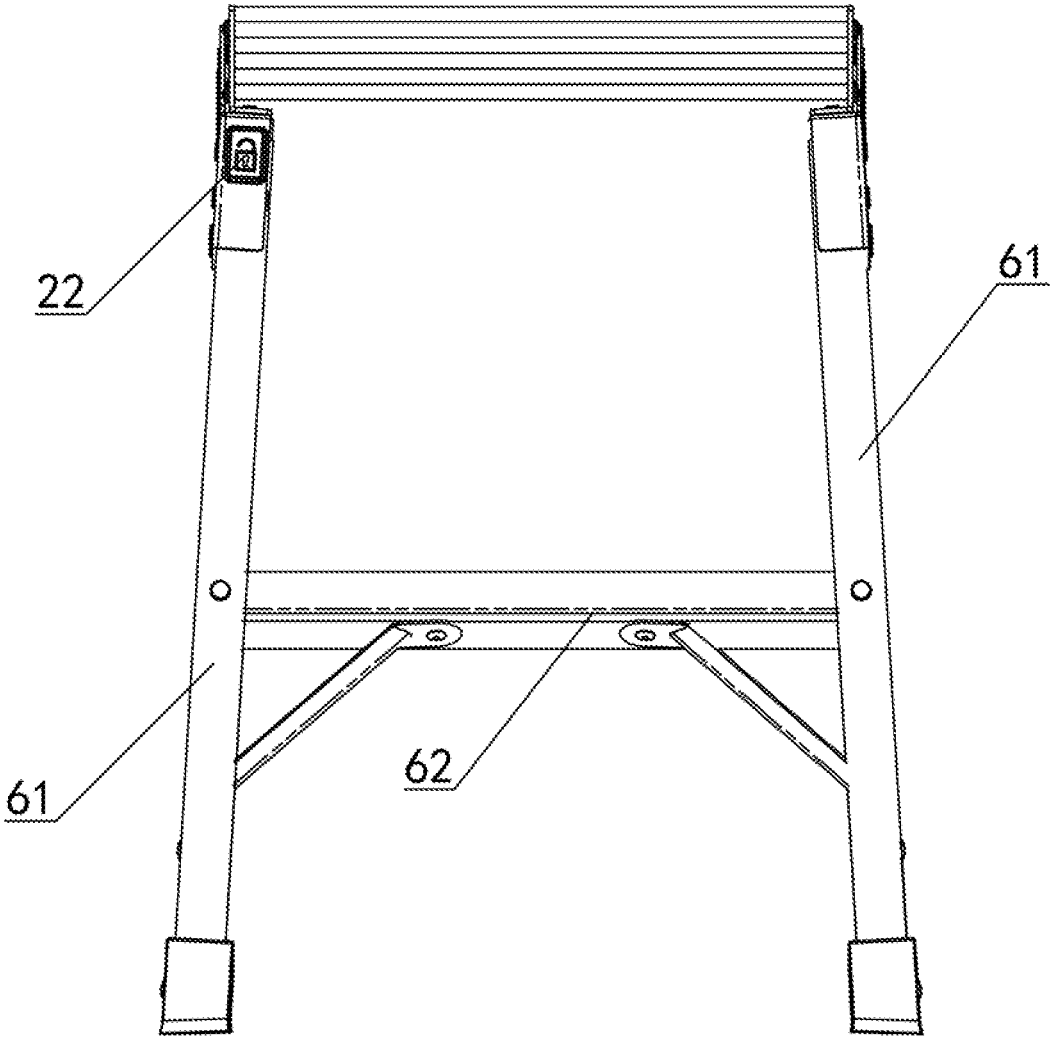
FIG. 5 is a schematic view 2 of the workbench of embodiment of this utility model (end)

In the above figures: 1. Ladder; 2. Platform; 3. Rung; 4. End cover structure; 5. Unlocking structure; 6. Ladder; 61. Column; 62. Step; 7. Platform; 8. Rung; 9. Hinged joint; 17. Rotating lock tongue; 18. First spring; 19. Rotating axis; 20. Locking hook; 21. Locking plate; 22. Press button; 23. First driving pin; 24. Locating slot; 25. Second spring; 26. Push button; 27. Bevel; 28. Second driving pin; 29. Rotating member; 30. Opening; 31. slope.

SPECIFIC EMBODIMENT

With reference to the accompanying figures and embodiment, the present utility model will be described in detail.

Embodiment: As shown in FIGS. 3-11, an unlocking structure of workbench ladder, and the workbench comprises two ladders 6 and a platform 7, and the upper ends of the two ladders 6 are respectively hinged to the front and rear ends of the platform 7 in the length direction; several rungs 8 are provided at the bottom of the platform 7 in parallel intervals along its length direction; the ladders 6 comprise two columns 61 and steps 62 connected between the two columns 61;

An unlocking structure is arranged on each of the ladder 6 respectively corresponding to its hinged joint with the platform 7, and the unlocking structure is used to lock the open and folded state of the two ladders 6 of workbench or the unlocking structure is used to unlock the two ladders 6 to so that they can rotate below the ends of the platform 7; in the open state of the ladder 6, the unlocking structure is arranged along the length direction of the platform 7;

The unlocking structure comprises an operating button, a rotating lock tongue 17 and a first spring 18;

The rotating lock tongue 17 is vertically arranged along the height direction of the ladder 61 and is rotatably arranged in the column 61, and the rotation axis 19 of the rotating lock tongue 17 is arranged along the width direction of the platform 7; the upper end of the rotating lock tongue 17 is a locking hook 20, and the locking hook 20 extends out of the top surface of the column 61 and is locked and positioned on a locking plate 21 at the bottom of the platform 7;

The first spring 18 acts between the rotating lock tongue 17 and the column 61 for driving the locking hook 20 to move toward the locking plate 21, so that the locking hook 20 is locked and positioned on the locking plate 21 to achieve the locking of the ladder 6 and the platform 7;

The operating button is protruded on the outer side of the column 61 along the length direction of the platform 7, and acts on the rotating lock tongue 17 to overcome the elastic force of the first spring 18 and drive the locking hook 20 to move in a direction opposite to the locking plate 21, thereby unlocking the lock which locks the locking plate 21 with the locking hook 20 and achieving the unlocking of the ladder 6 and the platform 7.

Figure 6:
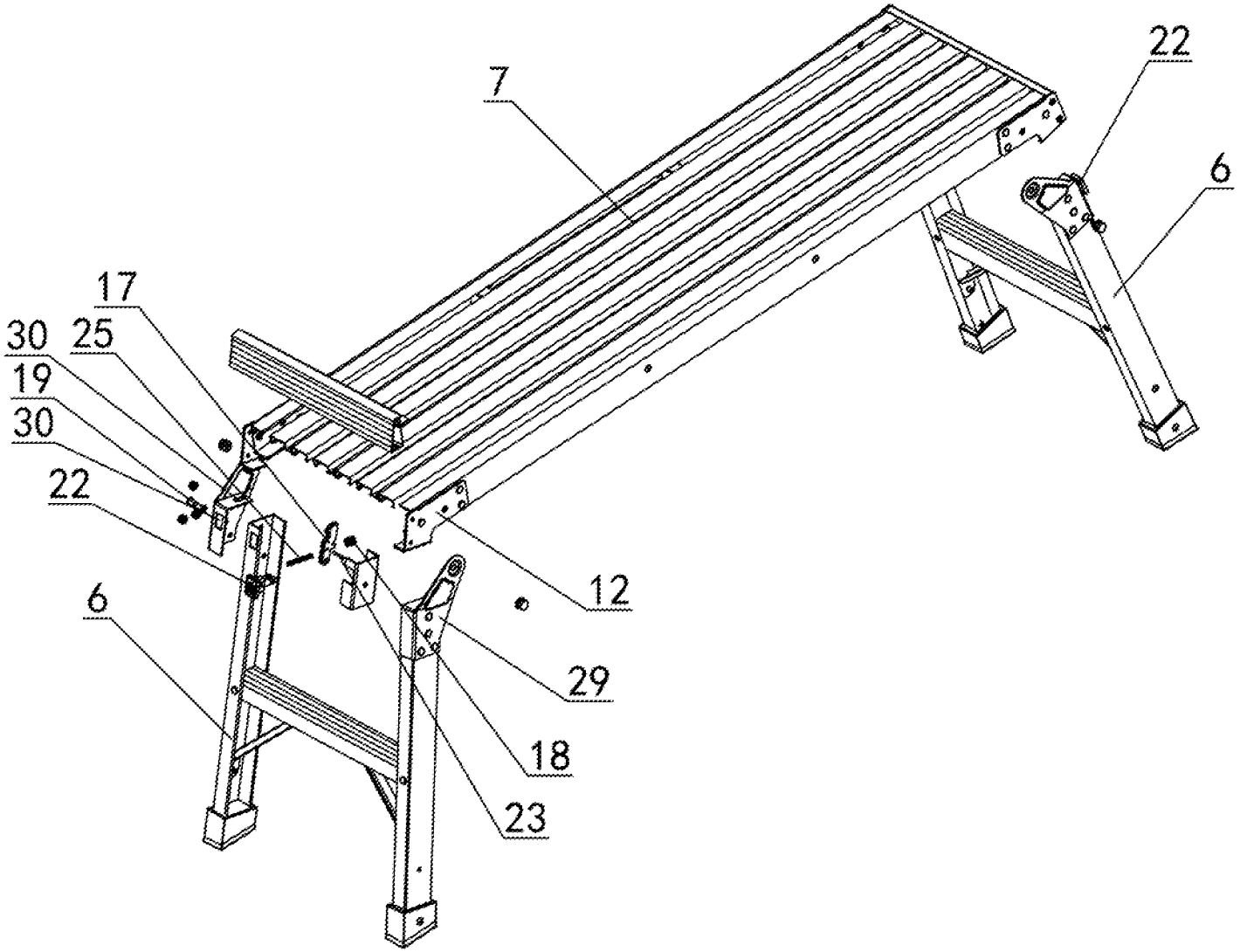
FIG. 6 is an exploded view of the workbench of embodiment of this utility model.
Figure 7:
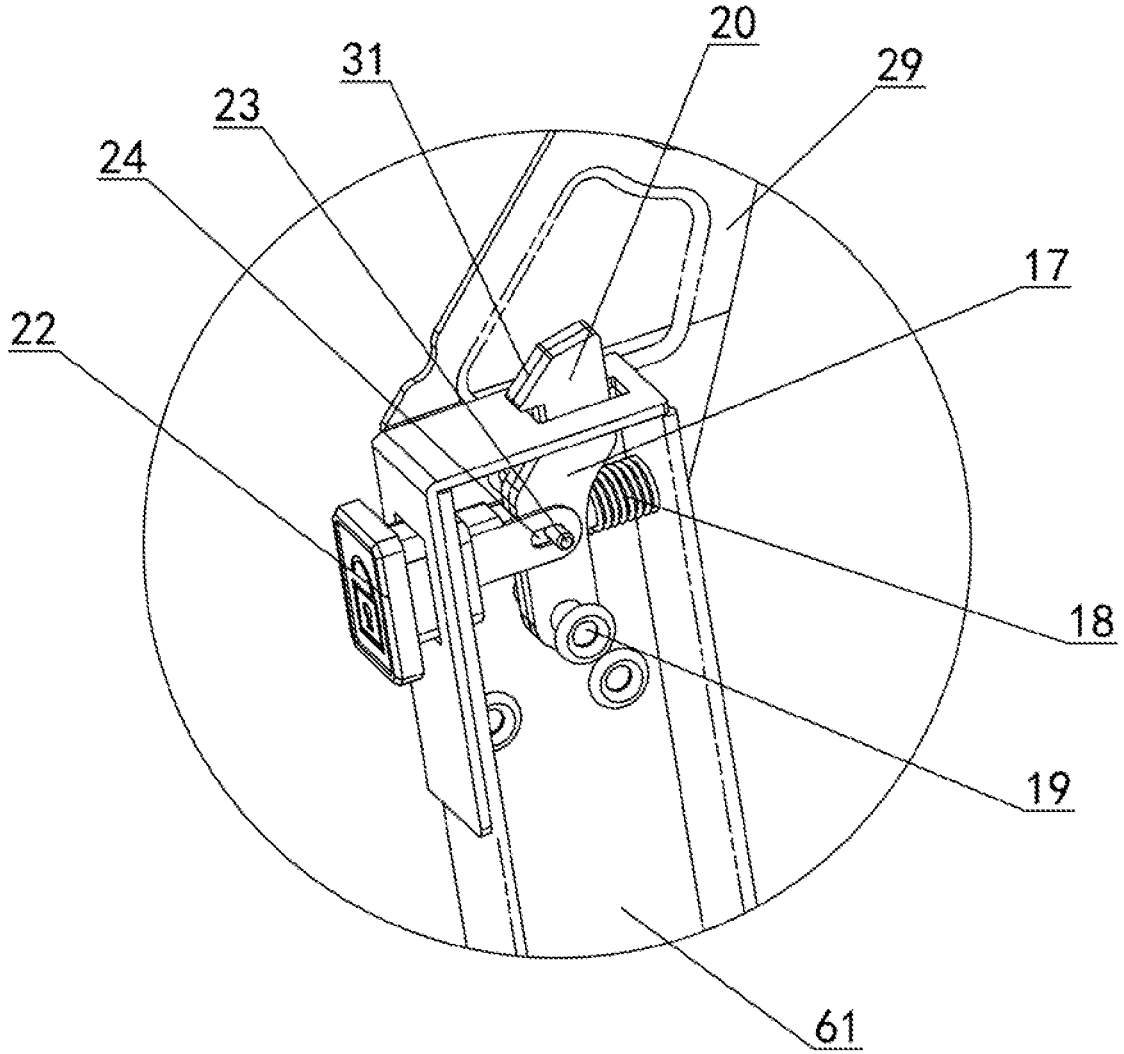
FIG. 7 is a schematic view 1 when the embodiment of the utility model is locked (press button type)
Figure 8:
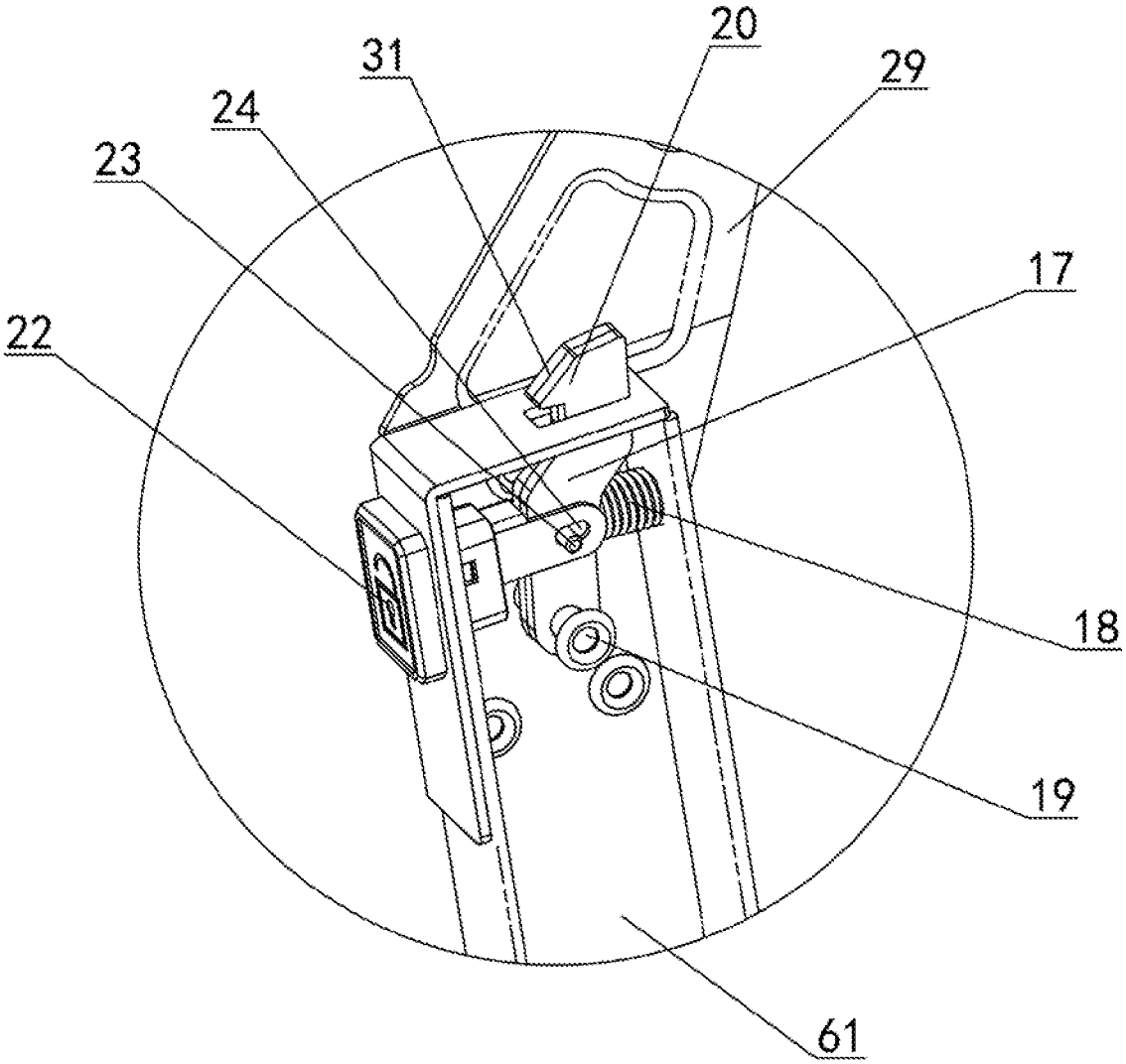
FIG. 8 is a schematic view 2 when the embodiment of the utility model is unlocked (press button type)

Wherein, as shown in FIGS. 6-8, the operating button is a press button 22 and a first driving pin 23 is positioned in the rotating lock tongue 17 and the first driving pin 23 is disposed parallel to the rotation axis of the rotating lock tongue 17; a locating slot 24 is disposed on the press button 22 in relative to the first driving pin 23, and the locating slot 24 is sleeved on the first driving pin 23 to become the point of force application of the press button 22 to the rotating lock tongue 17; the locating slot 24 has a length, which constitutes a stroke of point of force application by the press button 22 to the rotating lock tongue 17; and it also consists of a second spring 25 and the second spring 25 acts between the press button 22 and the rotating lock tongue 17;

In the open state of the ladder 6, the press button 22 applies a pressing force to the rotating lock tongue 17 in the forward and backward direction perpendicular to the length direction of the column 61 to force the rotation of the rotating lock tongue.

Figure 9:
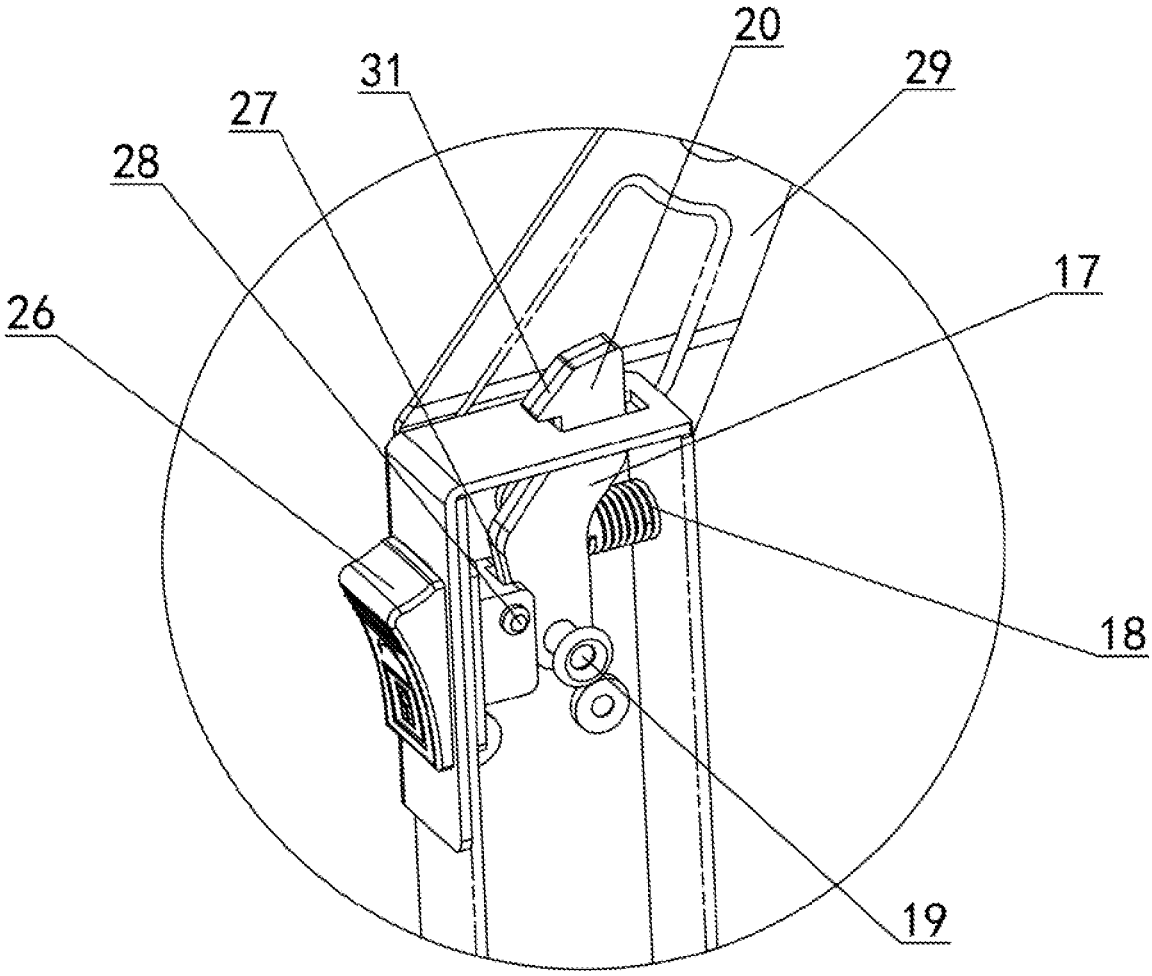
FIG. 9 is a schematic view 1 when the embodiment of the utility model is locked (push button type)
Figure 10:
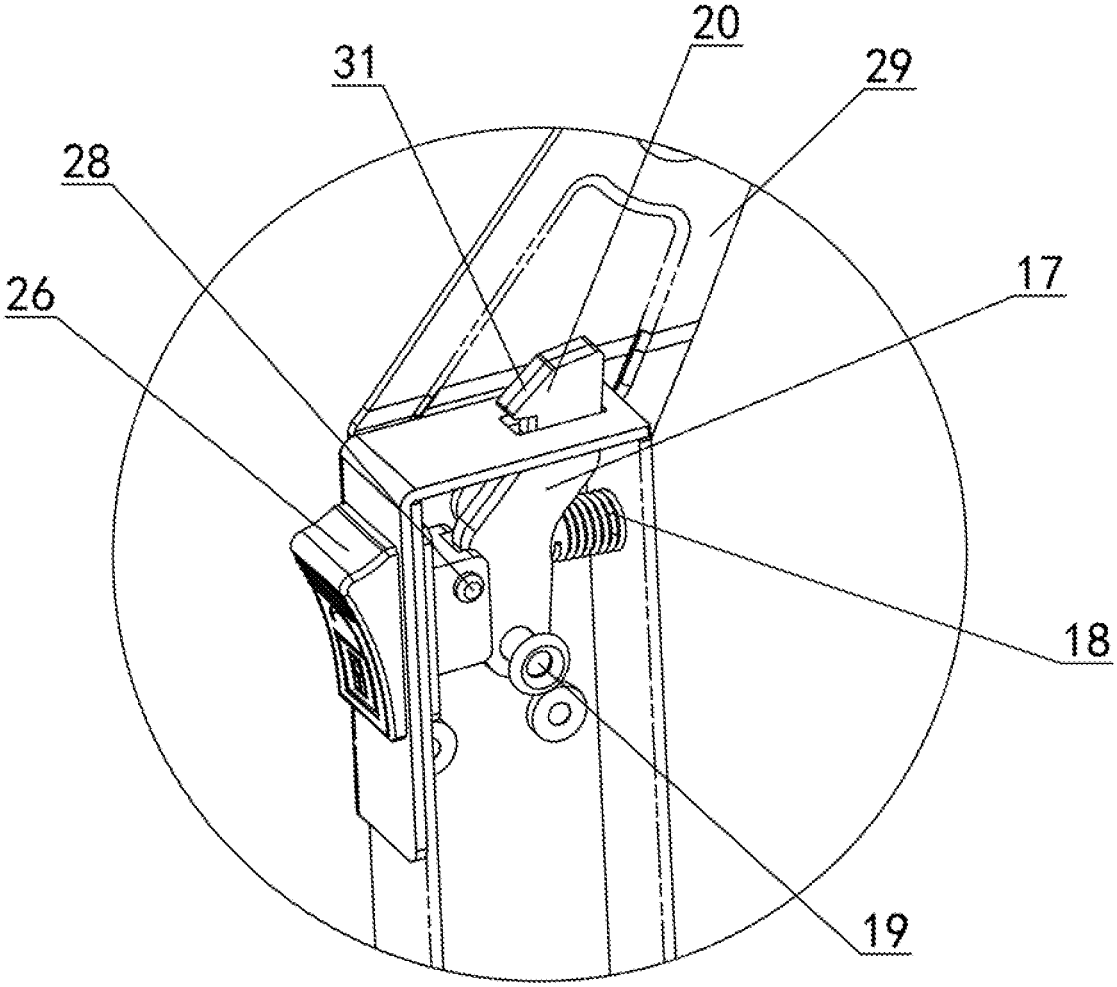
FIG. 10 is a schematic view 2 when the embodiment of the utility model is unlocked (push button type)
Figure 11:
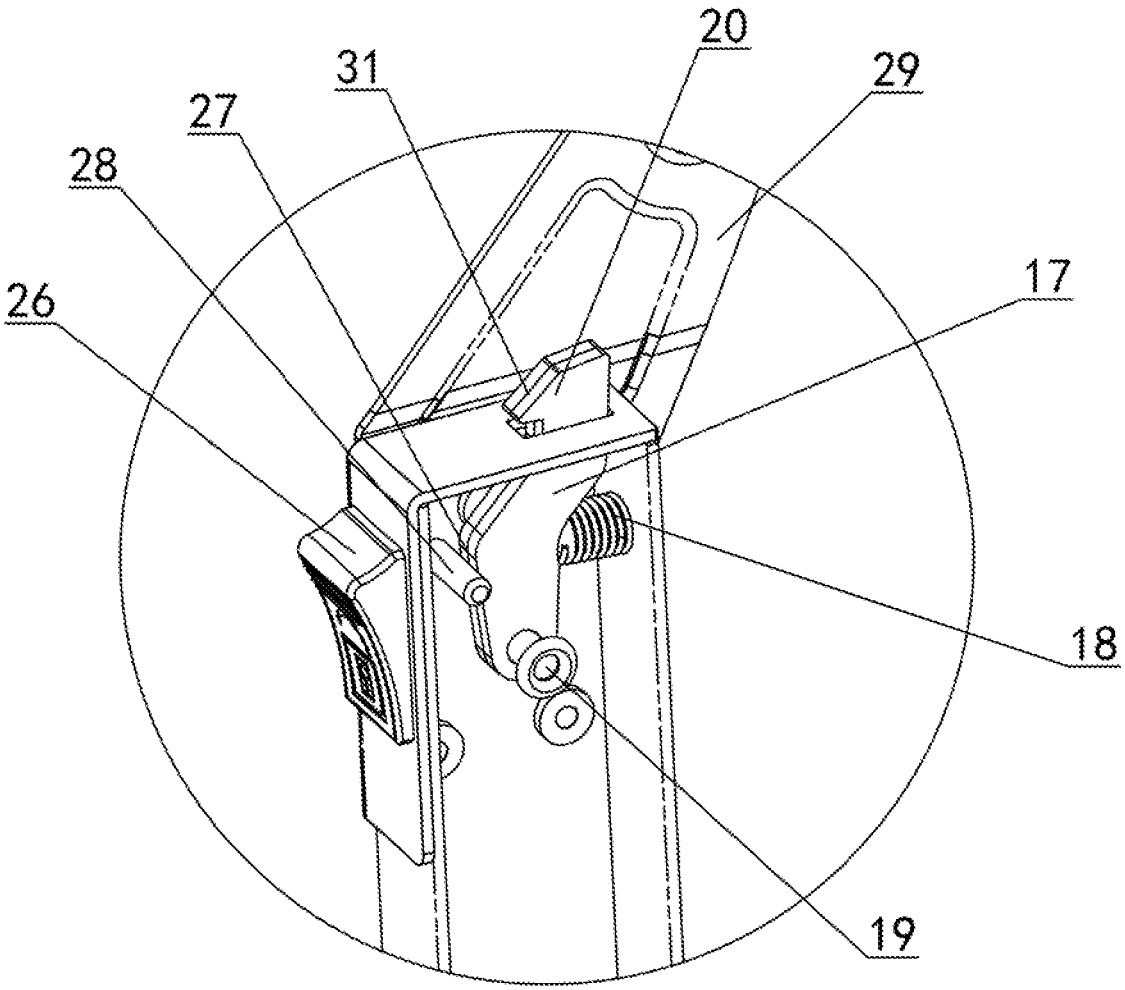
FIG. 11 is a schematic view after some structure in FIG. 10 is hidden.

Or, as shown in FIGS. 9-11, the operating button is a push button 26, and the rotating lock tongue 17 is provided with a bevel 27 along the length direction of the column 61 and a second driving pin 28 is positioned in the push button 26 in relative to the bevel 27 and the second driving pin 28 is disposed parallel to the rotation axis of the rotating lock tongue 17 and it abuts the bevel 27 to become a point of force application of the push button 26 to the rotating lock tongue 17; In the open state of the ladder 6, the push button 26 applies a pushing force to the bevel 27 of the rotating lock tongue 17 in the upward and downward direction parallel to the length direction of the column 61 to force the rotation of the rotating lock tongue 17.

Wherein, the locking hook 20 is provided with a slope 31 along the length direction of the rotating lock tongue 17 and the slope 31 works with the locking plate 21. When the ladder 6 is opened from the folding state, the slope 31 gradually abuts the locking plate 21 and when the ladder 6 is fully opened, the locking hook 20 is locked to the locking plate 21.

Wherein, it also includes a rotating member 29 and the rotating member 29 is fixed on the upper end of the column 61 and rotatably connected to the end of the platform 7 so that the ladder 6 is rotatably connected to the platform 7. The rotating member 29 is provided with two openings 30 for the passing through of the locking hooks of the operating button and the rotating lock tongue 17 respectively.

Compared with the prior art, the utility model has the smart structure design and has practical and progressive feature such as convenient unlocking operation.

It should be noted that the above described embodiments are only for illustration of technical concept and characteristics of present utility model with purpose of making those skilled in the art understand the present utility model, and thus these embodiments shall not limit the protection range of present utility model. The equivalent changes or modifications according to spiritual essence of present utility model shall fall in the protection scope of present utility model.

The invention claimed is:

1. An unlocking structure of a workbench ladder structure, the workbench ladder structure comprising two ladders and a platform, upper ends of the two ladders being respectively hinged to front and rear ends of the platform in a length direction of the platform, each one of the ladders comprising two columns and a step connected between the respective two columns, the unlocking structure comprising:

an operating button;

a rotating lock tongue; and a first elastic element, wherein the unlocking structure is arranged on each of the two ladders, at a location corresponding to a respective hinged joint of each of the two ladders with the platform, wherein in an open state of the ladder structure, the unlocking structure is arranged along a length direction of one column of the two columns of a respective ladder wherein the rotating lock tongue is perpendicularly arranged along a width direction of a respective one of the two columns and is rotatably arranged in a respective one column, and a rotation axis of the rotating lock tongue is arranged along a thickness direction of the respective one column, wherein an upper end of the rotating lock tongue is a locking hook, and the locking hook extends out of a top surface of the respective column and is locked and positioned on a locking plate at a bottom of the platform, wherein the first elastic element acts between the rotating lock tongue and the column and is configured to drive the locking hook to move toward the locking plate, so that the locking hook is locked and positioned on the locking plate to achieve a locked state of the respective ladder and the platform, and wherein the operating button protrudes from an outer side of the respective one column along the length direction of the one column, and acts on the rotating lock tongue to overcome a force of the first elastic element and drive the locking hook to move in a direction opposite to the locking plate, thereby unlocking the locking plate with the locking hook and achieving an unlocked state of the respective ladder and the platform.

2. The unlocking structure according to claim 1, wherein:

the operating button is a press button, a first driving pin is positioned in the rotating lock tongue, and the first driving pin is disposed parallel to the rotation axis of the rotating lock tongue, a locating slot or a locating hole is disposed on the press button in a position to receive the first driving pin, and the locating slot or the locating hole houses the first driving pin to become a point of force application of the press button onto the rotating lock tongue, in the open state of the ladder, the press button applies a pressing force to the rotating lock tongue in a forward and backward direction perpendicular to the length direction of the column to force the rotation of the rotating lock tongue.

3. The unlocking structure according to claim 2, wherein:

the press button is provided with the locating slot and the locating slot has a length which constitutes a stroke of the point of force application by the press button onto the rotating lock tongue.

4. The unlocking structure according to claim 2, wherein the first elastic element is a spring.

5. The unlocking structure according to claim 1, wherein:

the operating button is a push button, and the rotating lock tongue is provided with a bevel along the length direction of the column, a driving pin is positioned in the push button, the driving pin disposed parallel to the rotation axis of the rotating lock tongue, and abutting the bevel to become a point of force application of the push button onto the rotating lock tongue, and in the open state of the ladder, the push button applies a pushing force to the bevel of the rotating lock tongue in an upward and downward direction parallel to the length direction of the column to force the rotation of the rotating lock tongue.

6. The unlocking structure according to claim 5, wherein the first elastic element is a spring.

7. The unlocking structure according to claim 1, wherein the first elastic element is a spring.

8. The unlocking structure according to claim 1, wherein:

the locking hook is provided with a slope at an angle relative to the length direction of the rotating lock tongue and the slope works with the locking plate, when the respective ladder is opened from a folded state, the slope gradually abuts the locking plate and when the ladder is fully opened, the locking hook is locked to the locking plate.

* * * * *